United States Patent [19]

Hedlund

[11] Patent Number: 4,793,950

[45] Date of Patent: Dec. 27, 1988

[54] CARBURETOR WATER TRAP

[75] Inventor: Gregory B. Hedlund, Badger, Minn.

[73] Assignee: Polaris Industries, Inc., Minneapolis, Minn.

[21] Appl. No.: 7,055

[22] Filed: Jan. 27, 1987

[51] Int. Cl.[4] ..... F02M 9/06

[52] U.S. Cl. ..... 261/4; 261/72.1; 261/44.3; 210/251; 210/94

[58] Field of Search ..... 261/4, 7, 8, 44.3, 72.1; 210/94, 251; 138/89

[56] References Cited

U.S. PATENT DOCUMENTS

| | | | |
|---|---|---|---|
| 1,208,196 | 12/1916 | Pembroke | 261/70 |
| 1,717,875 | 6/1929 | Chandler | 210/94 |
| 1,987,981 | 1/1935 | Tice | 261/70 |
| 2,646,884 | 7/1953 | Findley | 210/94 |
| 2,690,842 | 10/1954 | Spluvak | 210/94 |
| 2,790,458 | 4/1957 | Kalert, Jr. | 261/72.1 |
| 3,550,776 | 12/1970 | Hamilton | 210/94 |
| 4,013,741 | 3/1977 | Edmmston | 261/44.3 |
| 4,044,080 | 8/1977 | Matsumoto et al. | 261/44.3 |
| 4,051,815 | 10/1977 | Coberley | 261/18.2 |
| 4,526,275 | 7/1985 | Nixon | 138/89 |

*Primary Examiner*—Tim Miles

*Attorney, Agent, or Firm*—Gregory P. Kaihoi; James R. Haller

[57] ABSTRACT

A water, ice and sediment trap attached to the lower portion of the fuel chamber of a carburetor for an internal combustion engine. The sediment trap receives and retain particles and fluids heavier than gasoline and stores them away from the fuel flow path. The sediment is retained in a transparent sediment tube which enables theuser to visibly inspect the trap for sediment accumulation. Sediment accumulation can be drained by removing a plug firmly received in the bottom end of the sediment tube.

11 Claims, 2 Drawing Sheets

CARBURETOR WATER TRAP

FIELD OF THE INVENTION

The invention relates to an improved water and retaining device, and has particular reference to a device for use on a carburetor assembly.

BACKGROUND OF THE INVENTION

At times, it is necessary to remove water, ice and other sediment from gasoline before it is burned in an internal combustion engine. Alcohol blended gasolines tend to absorb water, and under certain conditions the amount absorbed can become great enough that it will begin to separate from the gasoline. Deicers such as isopropyl alcohol help to minimize this problem, but the concentration of water which may accumulate in some of the new gasoline blends may exceed the amount deicers can effectively dissolve.

Sediment traps have been used in the past between the fuel pump and the carburetor to remove unwanted impurities. Such traps do not remove impurities introduced at the carburetor, however.

Variable-venturi carburetors are widely used in snowmobiles and similar vehicles. Such carburetors typically include a piston which variably occludes an air passage, serving as a throttle valve. A main jet fixed to a lower portion of a float bowl in the carburetor includes a needle jet having a needle carried at the bottom of the piston. The main jet opens to a fuel reservoir which is either part of or connected to the float chamber. During engine operation, fuel in the fuel reservoir is drawn into the main jet and metered in the gap between the needle and the needle jet. The fuel is mixed with air and passes into the combustion chamber of the engine.

Under certain conditions, particularly in snowmobiles and other smaller engines used in cold weather, water can condense in the carburetor and then feeeze into ice particles which may block or restrict the fuel jets. This blockage can cause poor engine performance and stalling. Furthermore, for engines that depend on an oil/fuel mixture for lubrication, a clogged jet may have catastrophic effects on the engine due to lack of lubrication.

DISCLOSURE OF THE INVENTION

The present invention provides a carburetor for an internal combustion engine which provides an air/fuel mixture to a combustion chamber. The carburetor is characterized by including a bowl for holding fuel prior to its mixture with the air, and trap means communicating with the bottom of the bowl for receiving and retaining water and other sediment. Preferably, the trap means oomprises an elongated tube attached at a first end to the bowl, the tube extending downwardly from the bowl and terminating in a second end having drain means for allowing accumulated water and sediment to be drained therefrom. Desirably, the drain means comprises a plug snugly received in the second end of said tube.

DETAILED DESCRIPTION OF THE PREFERRED EMBODIMENT

Figure 1:
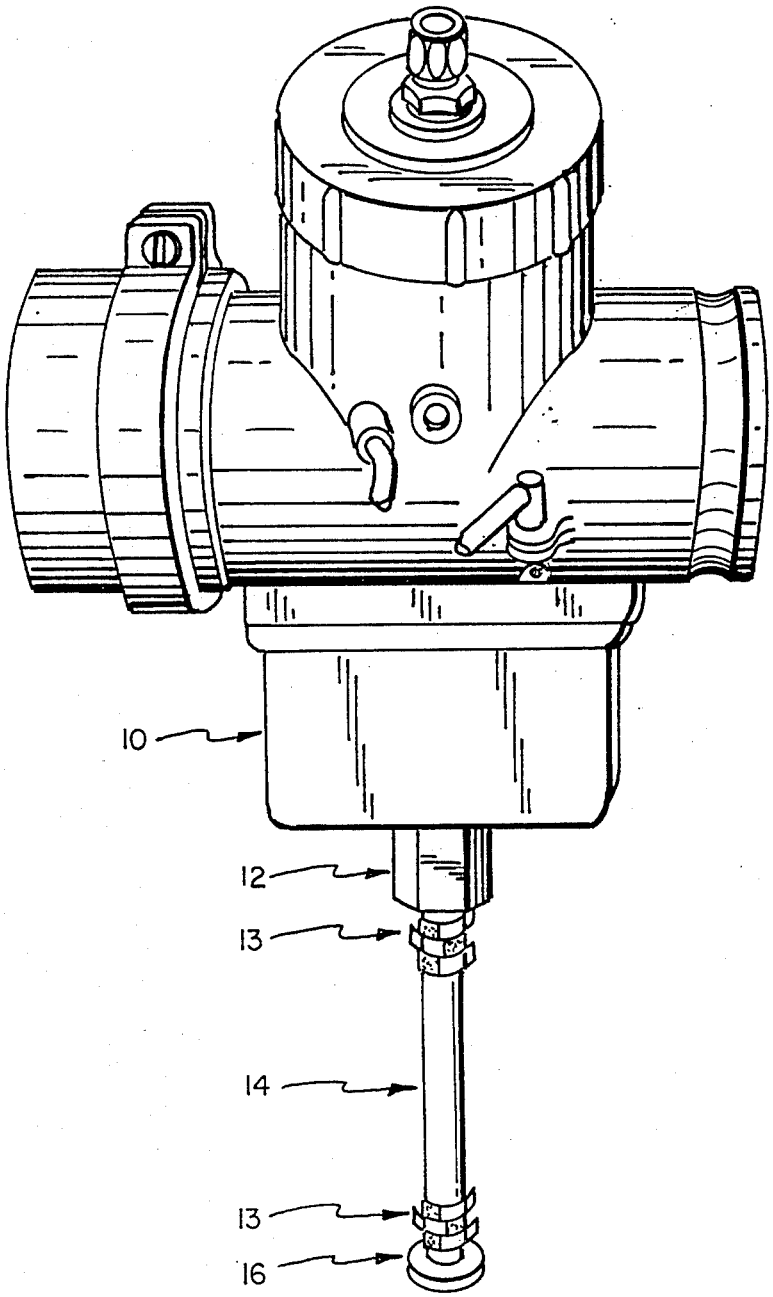
FIG. 1 is a perspective view of the device of the invention.
Figure 2:
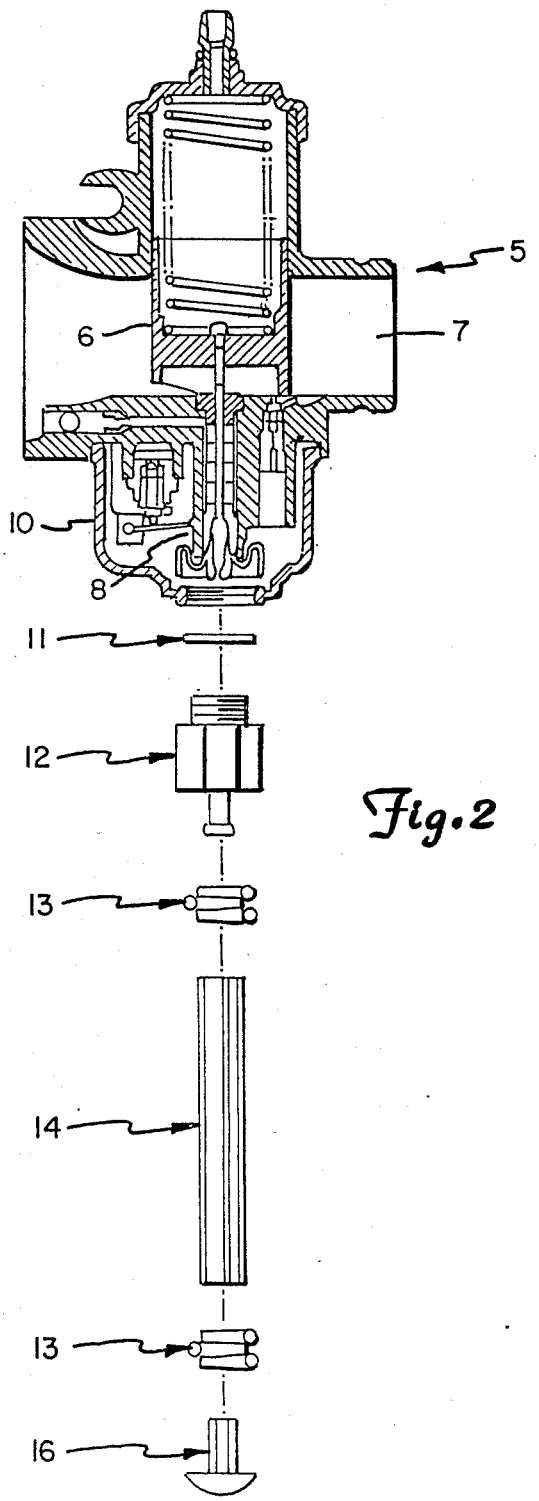
FIG. 2 is an exploded, partial crosssectional view of the device of the invention.

Referring to FIGS. 1 and 2, a carburetor (5) includes a piston (6) which variably occludes an air passage (7), serving as a throttle valve. A main jet (8) fixed to a lower portion of a fuel chamber (10) in the carburetor includes a needle jet having a needle carried at the bottom of the piston (6). The main jet opens to a lower portion of the fuel chamber (10). During engine operation, fuel in the fuel chamber (10) is drawn into the main jet (8) and metered in the gap between the needle and the needle jet. The fuel is mixed with air and passes into the combustion chamber of the engine. The carburetor water trap of the invention includes a trap uniquely designed to be attached to the lower portion of the fuel chamber (10). The trap means communicates with the bottom of the fuel chamber (10), receiving and retaining water, ice, and other sediment in the fuel system.

Preferably the trap means comprises an elongated sediment tube (14) of suitable fuel-resistant material such as well known plastics or nylons. The tube (14) is attached at a first end to the fuel chamber (10) and extends downwardly, terminating in a second end. Preferably the tube (14) is transparent, allowing visual inspection of the contents of the trap. Alternately, other configurations of chambers may be utiiized in lieu of the tube (14) to store and isolate water and sediment from the fuel chamber (10) of the carburetor.

A suitable one-way check valve, such as a ball valve, may also be incorporated in the tube (14) to prevent influx of water or sediment if the vehicle should inadvertently roll (as is common for snowmobiles and other small vehicles).

A bushing (12) provides an attachment means for securing the first end of the sediment tube (14) to the bottom of the carburetor assembly. A first end of the bushing (12) is threadingly received within the bottom of the carburetor assembly. The second end of the bushing (12) includes a nipple for receiving the sediment tube (14), secured by a suitable clamp (13). A centrally located orifice extends axially through the bushing (12), allowing water, ice, and other sediment to flow therethrough. An "O" ring (11) or other suitable sealing means may be employed to prevent fuel leakage from the connection between the carburetor assembly and the bushing (12).

Means is provided for draining accumulated water or other sediment. In one embodiment such means comprises a removable plug (16), snugly received in the second end of the sediment tube (14). The plug (16) may be formed of any suitable metal or plastic material and is shaped to fit snugly into the second end of the tube.

The plug (16) and bushing (12) may be attached to opposite ends of the sediment tube by any suitable means, including clamps (13) and (15) that fit over the tube and apply radially inward force on the outside surface of the tube (14). The clamps (13) and (15) may be formed out of any suitable metal, plastic or other material and may be designed to be removed from and applied to the tube (14) using the fingers.

In use, as impurities enter the fuel chamber (10), they will tend to settle to the bottom and into the trap. Once in the trap, the water and sediment will not easily become disturbed or remixed with fuel in the carburetor which is being drawn through the jet. When water and sediment has accumulated in the trap, it may be drained therefrom by removal of the plug (16). Alternately, a valve could be inserted in place of the plug (16) to simplify this procedure.

While a preferred embodiment of the present invention has been described, it should be understood that various changes, adaptations and modifications ma be made therein without departing from the spirit of the invention and the scope of the appended claims.

What is claimed is:

1. A carburetor for providing an air/fuel mixture to a combustion chamber of an internal combustion engine, the carburetor including a fuel jet having an inlet for metering the fuel being provided to the combustion chamber, an air passage through which air is provided to the combustion chamber, a bowl for holding fuel prior to its mixture with the air, and elongated flexible trap means communicating with the bottom of the bowl for receiving and retaining water and other unwanted substances spaced from the fuel jet inlet, the trap means being carried generally vertically beneath the fuel jet inlet.

2. The carburetor of claim 1 wherein said trap means includes drain means for allowing accumulated water to be drained therefrom.

3. The carburetor of claim 1 wherein the trap means comprises an elongated tube attached at a first end to the bowl, the tube extending downwardly from the bowl and terminating in a second end.

4. The carburetor of claim 3 further including drain means comprising a plug snugly received in the second end of said tube.

5. The carburetor of claim 4 further including clamp means for securing the tube to said plug.

6. The carburetor of claim 5 further including an attachment means for securing the first end of the sediment tube to the bottom of the carburetor bowl.

7. The improvement of claim 6 wherein the attachment means comprises a bushing threadingly received in the carburetor assembly.

8. The carburetor of claim 1 wherein said water trap is of sufficient size to retain a substantial volume of fluid.

9. The carburetor of claim 1 wherein said water trap is so configured and arranged as to receive and retain water condensed in the air passage.

10. In an internal combustion engine of the type having a carburetor for providing an air/fuel mixture to a combustion chamber, said carburetor including a bowl for holding fuel prior to its mixture with the air and a fuel jet having an inlet for metering the fuel being provided to the combustion chamber, the improvement comprising an elongated transparent trap means communicating with the bottom of the bowl for receiving and retaining water and other unwanted substances spaced from the fuel jet inlet, the trap means being carried generally vertically beneath the fuel jet inlet.

11. A carburetor for providing an air/fuel mixture to a combustion chamber of an internal combustion engine, the carburetor including a chamber for holding fuel prior to its mixture with the air, a fuel jet having an inlet for metering the fuel being provided to the combustion chamber, and elongated flexible trap means communicating with the bottom of the chamber for receiving and retaining water and other unwanted substances spaced from the fuel jet inlet, the trap means being carried generally vertically beneath the fuel jet inlet, said trap means comprising an elongated tube communicating at a first end with the chamber and extending downwardly, terminating in a second end; attachment means for securing the first end of the tube to the bottom of the fuel chamber, said attachment means comprising a bushing threadingly received in the bottom of the fuel chamber; and drain means for allowing accumulated water to be drained therefrom, the drain means including a plug snugly received in the second end of said tube, and a clamp for securing the tube to said plug.

* * * * *

UNITED STATES PATENT AND TRADEMARK OFFICE

CERTIFICATE OF CORRECTION

PATENT NO. : 4,793,950

DATED : December 27, 1988

INVENTOR(S) : Gregory B. Hedlund

It is certified that error appears in the above—identified patent and that said Letters Patent is hereby corrected as shown below:

Abstract. Line 7 of the Abstract, delete "theuser" and insert --the user-- .

Column 1, line 5, after "water", insert --removing-- .

Column 1, line 40, delete "feeeze" and insert --freeze-- .

Column 1, line 56, delete "oomprises" and insert --comprises-- .

Column 2, line 27, delete "utiiized" and insert --utilized-- .

Column 3, line 5, delete "ma" and insert --may-- .

Signed and Sealed this

Sixth Day of June, 1989

*Attest:*

*Attesting Officer*

DONALD J. QUIGG

*Commissioner of Patents and Trademarks*